United States Patent [19]

Kuhl

[11] Patent Number: 4,750,277

[45] Date of Patent: Jun. 14, 1988

[54] APPARATUS FOR DRYING OF ARTICLES TRAVELING UPON A CONVEYOR

[76] Inventor: Henry Y. Kuhl, Kuhl Rd., P.O. Box 26, Flemington, N.J. 08822

[21] Appl. No.: 848,618

[22] Filed: Apr. 7, 1986

[51] Int. Cl.[4] ..... F26B 15/12

[52] U.S. Cl. ..... 34/217; 34/233; 34/216; 34/236

[58] Field of Search ..... 34/71, 156, 155, 160, 34/216, 210, 217, 225, 233, 236

[56] References Cited

U.S. PATENT DOCUMENTS

| | | | |
|---|---|---|---|
| 2,442,475 | 6/1948 | Swanson . | |
| 2,588,787 | 3/1952 | Wright . | |
| 3,203,435 | 8/1965 | Kurtz . | |
| 3,349,419 | 10/1967 | Kuhl et al. . | |
| 3,771,235 | 11/1973 | Minoda et al. | 34/156 |
| 4,064,635 | 12/1977 | Kuhl . | |
| 4,173,831 | 11/1979 | McCord | 34/71 |
| 4,212,113 | 7/1980 | Andersson | 34/156 |
| 4,276,977 | 7/1981 | van Kattenbroek . | |
| 4,353,455 | 10/1982 | Mumma . | |
| 4,358,341 | 11/1982 | Bergquist . | |
| 4,472,887 | 9/1984 | Avedian et al. | 34/216 |

*Primary Examiner*—Larry I. Schwartz
*Attorney, Agent, or Firm*—Sperry, Zoda & Kane

[57] ABSTRACT

An apparatus for drying of articles traveling upon a conveyor which utilizes a housing defining a plenum chamber and a drying chamber therein for use in cooperation with a conveyor which enters the drying chamber at a conveyor inlet position and exits the drying chamber at a conveyor exit position. The plenum chamber is separated from the drying chamber by a particularly constructed airflow device which achieves various specific desired airflow patterns depending upon the type of article being carried upon the conveyor traveling through the drying chamber. A blower is included supplying pressurized air for drying to the plenum chamber where the pressure is equalized and applied in this manner to a plurality of slots defined in the airflow control. The slots are designed with the lower section having vertically extending walls and a upper section having outwardly flared walls to increase the downwardly exerted pressure by drying air traveling therethrough and to minimize turbulence of airflow as it enters the slots of the airflow control.

13 Claims, 2 Drawing Sheets

APPARATUS FOR DRYING OF ARTICLES TRAVELING UPON A CONVEYOR

BACKGROUND OF THE INVENTION

1. Field of the Invention

The present invention is usable in the field of drying devices which are specially compatible with conveying systems which can carry a multitude of different types of articles thereon. The present invention is adapted to be positioned about a conveyor to define a channel therethrough to allow conveyor to carry articles therein for drying and then to allow them to be exired. The conveyors can be of a variety of configurations including rollers, spools, chains or the like.

Although the present invention is usable with a great number of different types of articles traveling upon conveyors which must be dried, this configuration is specifically usable with egg conveying systems where eggs are arranged in rows upon a conveyor and are washed at a specific location. After the eggs exit the washing chamber, it is desirable that the eggs be dried immediately and the drying apparatus of the present invention can be used for that purpose. Also the present invention is particularly usable for drying of trays, racks and other carton-type configurations normally used in the fields of poultry, bakery related fields and the like.

2. Description of the Prior Art

Most of the prior art configurations merely direct the air downwardly directly from nozzles or other similar air directing devices onto the materials and conveyor thereunder. This airflow is rather turbulent and extremely noisy. Also this airflow has a tendency to be somewhat erratic. These problems are overcome by the present design wherein airflow is achieved in a somewhat laminar manner due to the unique configuration of the airflow control means of the present invention. With most prior art configurations, the air is merely directed toward the conveyor with no specific control. These standard blower-type configurations do not use the specific channeling advantages which are apparent from the configuration of the drawing means of the present invention.

SUMMARY OF THE INVENTION

The present invention provides an apparatus for drying of articles traveling upon a conveyor which includes a housing means with the interior thereof divided into a drying chamber and a plenum chamber. A conveyor inlet is defined to allow the conveyor and articles traveling thereon to enter the drying chamber for drying thereof. The housing also includes a conveyor outlet to allow the conveyor and articles traveling thereon to exit from the drying chamber after drying. A blower inlet is defined in the housing in fluid flow communication with respect to the plenum chamber to admit drying air therein. The housing also includes an air outlet in fluid flow communication with the drying chamber to allow the exit of drying air after it has contacted the wet product.

A blower is included with this configuration having a supply conduit connected to the blower inlet to blow air therethrough. This air may be heated or ambient. An airflow control means extends across the housing dividing the interior thereof between the plenum chamber and the drying chamber to restrict the flow of drying air only through a plurality of slots defined in the airflow control means.

These airflow control slots extend across the airflow control means and are generally rectangular in cross-section and comprise an upper section and a lower section. The lower section has vertically extending lower walls spatially disposed and extending vertically parallel with respect to one another to guide airflow directly downwardly onto articles traveling upon the conveyor thereunder. The upper sections of the airflow slots include upper walls flared outwardly with respect to one another to facilitate the flow of drying air therethrough and to minimize airflow turbulence.

The airflow control means comprising a plurality of airflow slots have a rectangular cross-section of a dimensional ratio of 5 to 1 or as great as 10 to 1. That is the longer side of the rectangular cross-section is five or ten times as great as the more narrow side of the rectangle.

Preferably the airflow slots extend parallel to one another and are parallel with respect to direction of movement of the conveyor means traveling through the drying chamber. This is particularly useful when used with eggs that are arranged in rows and are traveling upon the conveyor means. Preferably one drying slot is positioned above each row of eggs to facilitate drying thereof. When used for drying eggs or other articles, the slots can be above, below or on the sides of the conveyor to be able to direct air thereto from any anglear direction.

An access door may be defined within the wall of the plenum chamber to allow the operator to gain access to the interior of the plenum chamber. Also, the airflow control means preferably can be replaced to allow variability in the pattern of the airflow slots depending on the type of materials which are traveling upon the conveyor to be dried.

Sometimes it is preferable to include two plenum chambers, one upstream and one downstream with respect to one another, to provide two slots for downwardly directing drying air. This achieves an overall balancing of the pressure within the plenum chamber particularly due to the configuration of the upper portion of the individual slots in such a manner as to minimize turbulence and more efficiently dry articles traveling upon the conveyor. Preferably the airflow control means is of a polyethylene material.

During the drying of trays or cases, it has been found to be preferable that the slots of the airflow control means are positioned angularly oblique with respect to the direction of movement of the conveyor. That is they are neither parallel nor perpendicular to the direction movement of the conveyor but they are indeed parallel with respect to each other. That is the slots are parallel with respect to one another. With this configuration, problems known heretofore such as excessive noise, whistling, or turbulence when the air contacts the generally square or rectangular trays has been avoided.

It is an object of the present invention to provide an apparatus for drying of articles traveling upon a conveyor which is inexpensive to manufacture.

It is an object of the present invention to provide an apparatus for drying of articles traveling upon a conveyor which has minimal maintenance requirements.

It is an object of the present invention to provide an apparatus for drying of articles traveling upon a conveyor which allows high speed drying of articles traveling on the conveyor.

It is an object of the present invention to provide an apparatus for drying of articles traveling upon a conveyor which allows drying of various different types of articles utilizing the same drying station configuration.

It is an object of the present invention to provide an apparatus for drying of articles traveling upon a conveyor which includes interchangeable airflow control means depending upon the type of article being dried.

It is an object of the present invention to provide an apparatus for drying of articles traveling upon a conveyor which is particularly usable for the drying of eggs arranged in rows upon the conveyor.

It is an object of the present invention to provide an apparatus for drying of articles traveling upon a conveyor which is particularly usable for the drying of baking trays or poultry trays by utilizing drying slots which are angularly oblique with respect to the direction of movement of these trays upon a conveyor.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
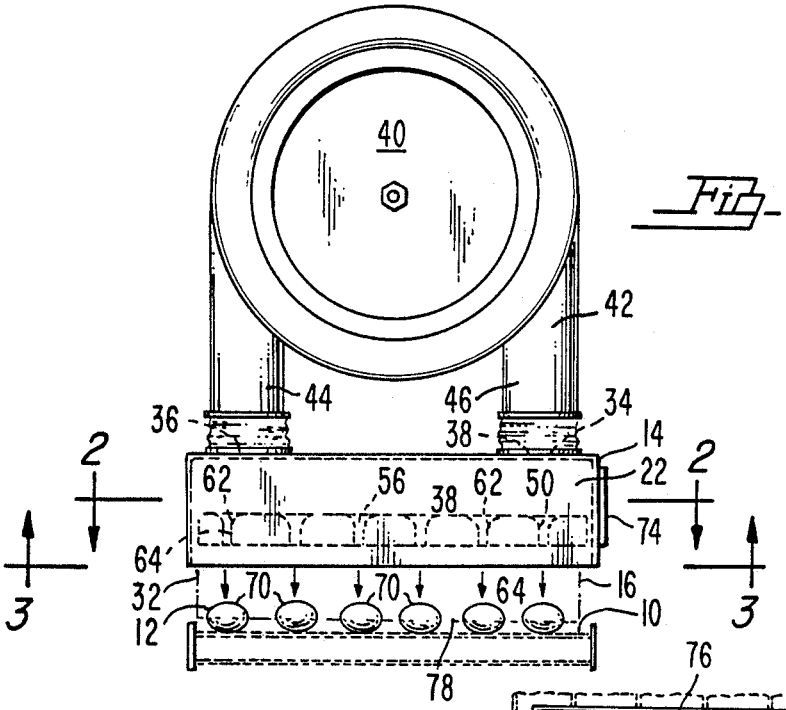
FIG. 1 is a front plan view of an embodiment of an apparatus for drying of articles traveling upon the conveyor embodying the present invention.
Figure 2:
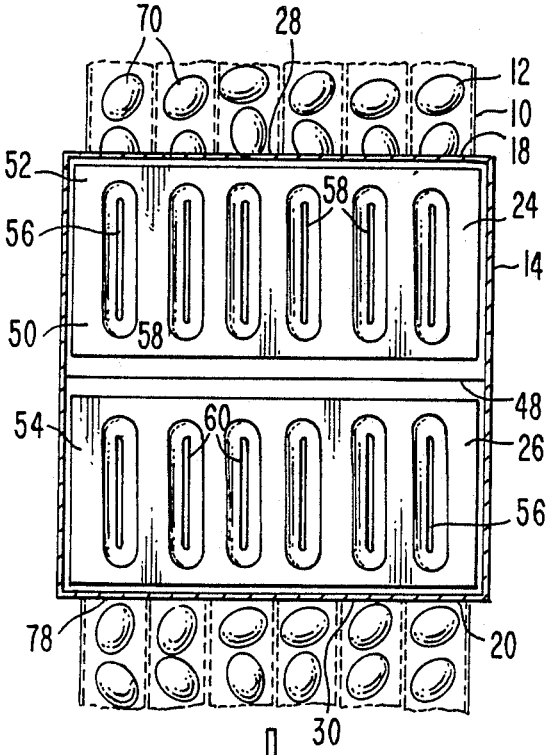
FIG. 2 is a cross-section of the embodiment shown in FIG. 1 along lines 2—2.
Figure 4:
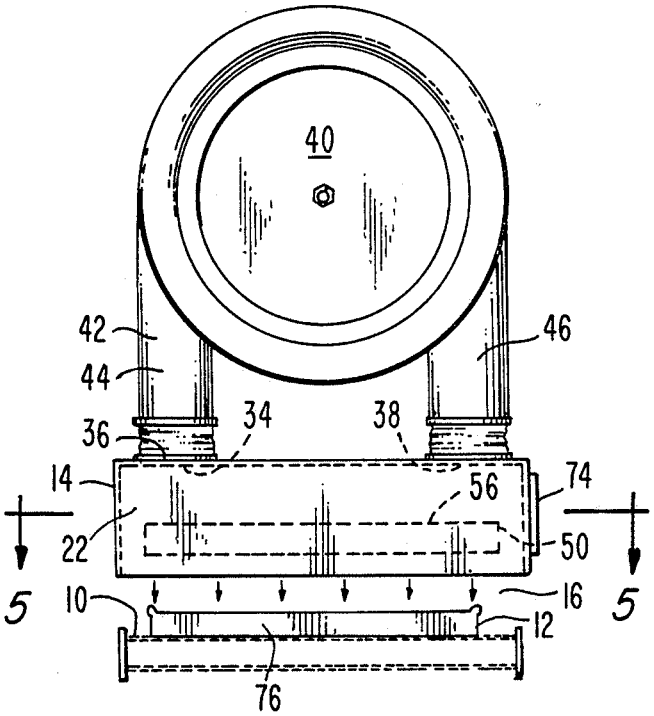
FIG. 4 is a front plan view of an embodiment of an apparatus for drying of articles traveling upon a conveyor utilizing airflow control means particularly usable for drying of bakery trays and poultry trays.
Figure 6:
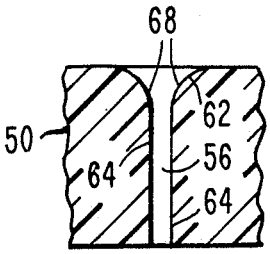
FIG. 6 is a cross-sectional view of a preferred embodiment of the airflow slot of the present invention.

The present invention provides a conveyor 10 particularly usable for the conveying of articles 12 traveling thereon. These articles 12 may take the form of various items such as eggs 70 or trays 76. Eggs 70 are best shown in FIGS. 1 and 2 and the configuration for use with trays is best shown in FIG. 4.

A housing means 14 is included such as to define a drying chamber 16 and a plenum chamber 22. Chamber 16 and chamber 22 are separated by an airflow control means 50. Airflow control means 50 preferably include a plurality of airflow slots 56 which can extend at various angular orientations with respect to the direction of movement of articles upon conveyor 10.

The housing 14 will define a conveyor inlet 28 to allow the conveyor and articles being carried thereon to enter into the drying chamber 16. Also a conveyor outlet 30 is defined within housing means 14 to allow exiting of the articles and conveying means from drying chamber 16. A blower means 40 is adapted to supply drying air through a supply conduit 42. This drying air can be heated or room temperature. A blower inlet 34 is defined in the wall of housing means 14 and is in fluid flow communication with respect to the plenum chamber 22.

The airflow slots 56 of airflow control means 50 include an upper section 62 and a lower section 64. Lower section 64 includes vertically extending lower walls 66 to allow drying air to be directed vertically downwardly directly onto articles traveling upon the conveyor 10 therebelow. The upper section 62 includes upper walls 68 which are flared outwardly with respect to one another to provide more smooth flow of drying air through airflow slots 56 downwardly. Preferably the airflow control means 50 is of a polyethylene material which facilitates machining of the slots in the exactly desired configuration of the present invention to facilitate airflow. The airflow control means 56 preferably is also selectively removable in order to allow variations in the configurations of the airflow slots 56 depending upon airflow conditions or the type of articles being carried upon the conveyor to be dried.

In one configuration the airflow slots 56 will extend parallel with respect to the movement of articles upon the conveyor. This is particularly usable when eggs are being carried in rows by conveyor 10. The rows of eggs 70 can be dried most effectively by a slot which extends parallel with respect to the direction of movement of the row of eggs such that each egg is exposed to drying over a specific length of movement upon the conveyor 10.

Figure 5:
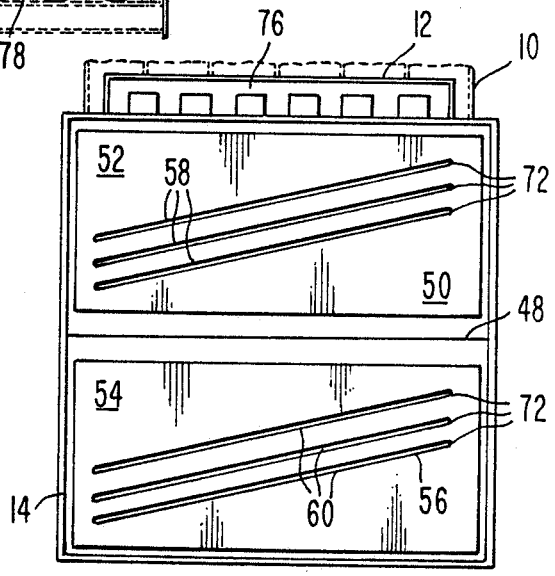
FIG. 5 is a cross-sectional view of the configuration shown in FIG. 4 along lines 5—5.
Figure 3:
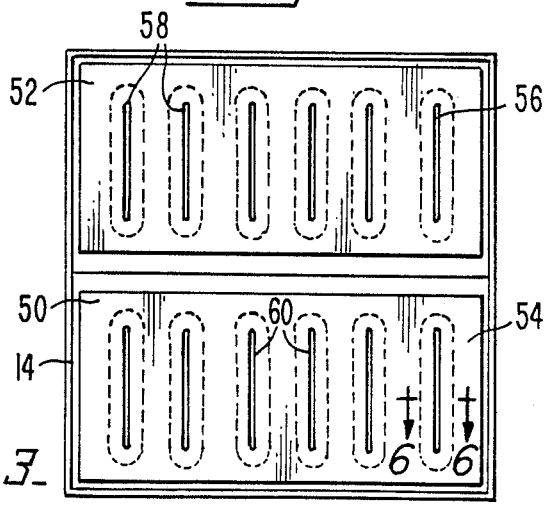
FIG. 3 is a cross-section of the embodiment shown in FIG. 1 along lines 3—3.

When used with trays 76, the present invention is particularly usable with an airflow control means 50 having angularly oblique slots 72 as best shown in FIG. 5. It has been shown that such angularly oblique slots prevent excessive noise such as air rushing or whistling when air is directed downwardly onto normally square or rectangular configurations such as bakery trays or poultry trays.

To facilitate the flow of air through the airflow slots 56 defined in airflow control means 50, the housing 14 may include an access door 74. This access door will be usable for a variety of reasons such as allowing easy changeover to various airflow control configurations 50.

The plenum chamber 22 of the present invention allows the air entering therein from blower means 40 to achieve an overall average pressure such that downwardly exerted airflow through the plurality of airflow slots 56 is overall equal. This flow is also made more laminar and less turbulent by the specific configuration of the flared upper walls 68 of each individual airflow slot 56. As air travels downwardly through the slot, the cross-sectional area thereof gradually decreases with an increase in speed of airflow resulting in more efficient air drying of the articles upon the conveyor.

In a preferred configuration, the drying chamber 16 is divided into a first upstream section 18 and a second downstream section 20. Similarly, the plenum chamber 22 is divided into a first plenum chamber 24 and a second plenum chamber 26. This division is achieved by way of a central dividing wall 48 which extends vertically downwardly through the housing means 14. With this configuration, the blower inlet 34 will include a first blower inlet 36 and a second blower inlet 38. First blower inlet 36 will be defined in the wall of the housing 14 adjacent the first plenum chamber 34. Second blower inlet 38 will be defined within the wall of housing means 14 adjacent second plenum chamber 26. A first supply conduit 44 will be connected from the blower 40 to the first blower inlet 36 and a second supply conduit 46 will be connected between blower means 40 and second blower inlet 38.

With this configuration, two specific airflow control means will be included. A first airflow control means 52 will be positioned within housing means 14 between the first plenum chamber 24 and the first upstream section 18 of drying chamber 16. Similarily, the second airflow control means 54 will be positioned within housing means 14 between the second downstream section 20 of drying chamber 16 and the second plenum chamber 26. With this configuration, first airflow slots 58 will be defined within the first airflow control means 52 and second airflow slots 60 will be defined within the second airflow control means 54.

The airflow slots in the single or double configuration will all preferably be of a rectangular ratio of approximately 5 to 1 or 10 to 1 in order to allow a long slender knifelike shot of downwardly directed air to be exerted upon the eggs or trays traveling upon the conveyor therebelow. Also better control of airflow is achieved by the inclusion of a resilient flap means 32 extending across the air outlet 78 defined by housing means 14. In this manner, the air within the drying station will be allowed to achieve a higher pressure prior to exiting through air outlet 78.

With this configuration utilizing the single or double plenum chamber system, the utilization of the plenum chamber itself allows for an equalization of the overall airflow downwardly onto the conveyor. Also, the particular cross-sectional shape of the individual airflow control slots is particularly advantageous in order to assure that this downward flow is smooth and minimal turbulence is experienced. Also, the double plenum chamber configuration has found to be particularly proficient in achieving an overall drying while minimizing the amount of air utilized. The baffling effect achieved by the airflow control means 50 of the present invention with the relatively narrow and long and slender airflow slots 56 also is extremely efficient in minimizing air consumption.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An apparatus for drying of articles traveling upon a conveyor comprising:

(a) a housing means defining a drying chamber and a plenum chamber therein, said housing means further defining a conveyor inlet therein to allow the conveyor and articles traveling thereon to enter said drying chamber for drying, said housing means further defining a conveyor outlet therein to allow the conveyor and articles traveling thereon to exit from said drying chamber after drying, said housing means also including a blower inlet in fluid flow communication with respect to said plenum chamber to admit drying air therein, said housing means further defining an air outlet in fluid flow communication with respect to said drying chamber to allow exit of spent drying air;

(b) a blower means including a supply conduit connected in fluid flow communication with respect to said blower inlet and said plenum chamber of said housing means to admit air therein for drying;

(c) an airflow control means extending through said housing means dividing the interior of said housing means into said plenum chamber means and said drying chamber means to prevent fluid flow communication therebetween other than through said airflow control means, said airflow control means defining a plurality of airflow slots being parallel with respect to one another and extending completely across said airflow control means to be positioned above the complete lateral width of the conveyor therebelow and articles traveling thereon and extending in a direction angularly oblique with respect to the direction of movement of eggs traveling upon the conveyor therebelow to direct drying air from said plenum chamber into said drying chamber and onto articles carried upon the conveyor therebelow for drying, each of said airflow slots being generally rectangular in cross-section and including an upper section and a lower section thereof, said lower section including vertically extending lower walls spatially disposed and extending vertically parallel with respect to one another to guide drying airflow directly onto articles traveling upon the conveyor, said upper sections of said airflow slots including upper walls flared outwardly with respect to one another to facilitate the flow of drying air therethrough with a minimum of airflow turbulence.

2. The apparatus as defined in claim 1 wherein said airflow slots are of rectangular cross-section with sides of a dimensional ratio of 5 to 1.

3. The apparatus as defined in claim 1 wherein said airflow slots are of rectangular cross-section with sides of a dimensional ratio of 10 to 1.

4. The apparatus as defined in claim 1 further including an access door positioned in said housing to provide access to said plenum chamber.

5. The apparatus as defined in claim 1 wherein said airflow control means is detachably removable with respect to said housing to allow for selective modification of the configuration of said airflow slots to facilitate drying of different types of articles traveling upon the conveyor means.

6. The apparatus as defined in claim 1 further comprising a resilient flap means extending at least partially across said air outlet to maximize drying by the air prior to exiting of the drying chamber.

7. The apparatus as defined in claim 1 wherein said airflow control means is made of polyethylene.

8. An apparatus for drying of articles traveling upon a conveyor comprising:

(a) a housing means defining drying chamber having a first upstream section and a second downstream section therein, said housing means also defining a first plenum chamber and a second plenum chamber therein, said housing means further defining a conveyor inlet therein to allow the conveyor and articles traveling thereon to enter said first upstream section of said drying chamber for drying thereof, said housing means further defining a conveyor outlet therein to allow the conveyor and articles traveling thereon to exit from said second downstream section of said drying chamber after drying, said housing means also including a first blower inlet in fluid flow communication with respect to said first plenum chamber to admit drying air therein, said housing means further including a second blower inlet in fluid flow communication with respect to said second plenum chamber to admit drying air therein, said housing means further defining an air outlet in fluid flow communication with respect to said drying chamber to allow exit of spent drying air;

(b) a blower means including a first supply conduit connected in fluid flow communication with respect to said first blower inlet to blow drying air into said first plenum chamber, said blower means also including a second supply conduit in fluid flow communication with respect to said second blower inlet to blow drying air into said second plenum chamber;

(c) a central dividing wall extending through housing means partitioning said first plenum chamber from said second plenum chamber;

(d) a first airflow control means extending through said housing means and cooperating with said central dividing wall to define said first plenum chamber and said first upstream portion of said drying chamber and preventing fluid flow communication therebetween other than through said first airflow control means, said first airflow control means defining at least one first airflow slot extending across said first airflow control means in a direction angularly oblique with respect to the directon of movement of eggs traveling upon the conveyor therebelow to direct drying air from said first plenum chamber into said first portion of said drying chamber and onto articles carried upon the conveyor therebelow for drying, each of said first airflow slots being generally rectangular in cross-section and including an upper section and a lower section thereof, said lower section including vertically extending lower walls spatially disposed and extending vertically parallel with respect to one another to guide drying airflow directly onto articles traveling upon the conveyor within said first upstream section of said drying chamber, said upper sections of said first airflow slots including upper walls flared outwardly with respect to one another to facilitate the flow of drying air therein with a minimum of airflow turbulence; and (e) airflow control means extending through said housing means and cooperating with said central dividing wall to define said second plenum chamber and said second upstream portion of said drying chamber and preventing fluid flow communication therebetween other than through said second airflow control means, said second airflow control means defining at least one second airflow slot extending across said second airflow control means to direct drying air from said second plenum chamber into said second portion of said drying chamber and onto articles carried upon the conveyor traveling therethrough for drying thereof, each of said second airflow slots being generally rectangular in cross-section and including an upper section and a lower section thereof, said lower section including vertically extending lower walls spatially disposed and extending vertically parallel with respect to one another to guide drying airflow directly onto articles traveling upon the conveyor within said second downstream section of said drying chamber therebelow, said upper sections of said second airflow slots including upper walls flared outwardly with respect to one another to facilitate the flow of drying air therein with a minimum of airflow turbulence.

9. The apparatus as defined in claim 8 wherein said first airflow slots and said second airflow slots are parallel with respect to one another and extend in a direction parallel with respect to the direction of movement of the conveyor means traveling through said drying chamber.

10. The apparatus as defined in claim 8, for particular use with eggs traveling in a specified number of rows upon the conveyor, wherein one of said first airflow slots and one of said second airflow slots is positioned immediately above each of the rows of eggs traveling upon the conveyor therebelow to facilitate complete drying thereof.

11. The apparatus as defined in claim 10, for use with six rows of eggs traveling upon the conveyor, comprising six rows of airflow slots positioned above the six rows of eggs.

12. The apparatus as defined in claim 8 wherein said first airflow slots are parallel with respect to one another and extend in a direction angularly oblique with respect to the direction of movement of the conveyor.

13. The apparatus as defined in claim 8 wherein said second airflow slots are parallel with respect to one another and extend in a direction angularly oblique with respect to the direction of movement of the conveyor.

* * * * *